United States Patent [19]

Mazzanti

[11] Patent Number: 4,858,870

[45] Date of Patent: Aug. 22, 1989

[54] HANGER CLAMP FOR GARMENT BAGS, WITH MOVABLE HANGER RETAINING ELEMENTS

[75] Inventor: Rino Mazzanti, Bologna, Italy

[73] Assignee: Lenox Incorporated, Lawrenceville, N.J.

[21] Appl. No.: 301,800

[22] Filed: Jan. 25, 1989

[51] Int. Cl.[4] ..... A47F 5/00

[52] U.S. Cl. ..... 248/316.1; 24/460; 24/513; 24/521; 211/89; 211/124; 206/291

[58] Field of Search ..... 248/316.1, 316.2, 316.3, 248/316.5, 316.6, 309.1; 24/460, 513, 515, 521; 211/89, 124; 206/289, 290, 291, 293, 279, 285, 287; 190/41 B

[56] References Cited

U.S. PATENT DOCUMENTS

| | | | |
|---|---|---|---|
| Re. 31,075 | 11/1982 | London et al. . | |
| 1,948,019 | 2/1934 | Ballentine . | |
| 3,566,456 | 3/1971 | London . | |
| 4,252,220 | 2/1981 | London et al. . | |
| 4,363,388 | 12/1982 | London et al. . | |
| 4,618,058 | 10/1986 | Gregg et al. . | |
| 4,640,414 | 2/1987 | Mobley et al. . | |
| 4,732,270 | 3/1988 | Myers et al. | 206/289 |
| 4,753,342 | 6/1988 | Pulichino, Jr. et al. | 248/316.1 X |
| 4,769,878 | 9/1988 | Liao | 206/279 X |
| 4,798,289 | 1/1989 | Mobley | 248/316.6 X |

FOREIGN PATENT DOCUMENTS 1122257 8/1968 United Kingdom .

*Primary Examiner*—Ramon O. Ramirez
*Attorney, Agent, or Firm*—Steele, Gould & Fried

[57] ABSTRACT

A trolley clamp for retaining hangers in a garment bag has a rigid frame with an at least partly horizontal lower support bar and is mountable below a top inside of the garment bag. The support carries a plurality of movable hanger-retaining elements between which clothes hangers are captured when the movable elements are abutted against one another. The hanger retaining elements have contoured faces with half-round depressions for matching the contour of the clothes hangers. A pivotable eccentric at the front distal end of the support bar is movable to force the hanger retaining elements into abutment or to allow the hanger retaining elements to separate from one another, allowing space for removal of the clothes hangers.

19 Claims, 2 Drawing Sheets

HANGER CLAMP FOR GARMENT BAGS, WITH MOVABLE HANGER RETAINING ELEMENTS

BACKGROUND OF THE INVENTION

1. Field of the Invention

This invention relates to the field of hanger clamps for garment bags, also known as trolley clamps, and especially to a hanger clamp for removably mounting clothes hangers of varying diameters at the top inside of a garment bag.

2. Prior Art

Trolley clamps for mounting inside garment bags are known having various forms of jaw structures that grasp the hooked ends of clothes hangers placed in the trolley clamp. The objective is to prevent the hangers from dropping off the trolley clamp into the garment bag when the garment bag is jostled during transport. Typically, such trolley clamps have two jaw elements pivotable relative to one another on a horizontal axis at the back wall of the garment bag, and are provided with a clasp means whereby the jaws can be fixed against one another to bear against the hangers. Examples of pivoting jaw retaining clamps are disclosed, for example, in U.S. Pat. Re. Nos. 31,075-London et al (original patent No. 4,252,220); 4,640,414-Mobley et al; 4,618,058-Gregg et al; 4,363,388-London et al; 3,566,456-London; and 1,948,019-Ballentine. These disclosures vary substantially in their particulars, however, in each case there are two opposed jaws which engage all the hangers placed on the trolley clamp.

In movable-jaw trolley clamps, there is a problem with some clamps in that the hangers can be inadvertently dropped from the trolley clamp when the clamp opens because the lower jaw falls freely away from the upper jaw. At least the user is required to manipulate the trolley clamp using two hands, which makes it very difficult to manipulate hangers at the same time. In order to avoid problems, the London '388 patent and the London '075 patent provides retainers whereby the lower jaw can only drop to a limited angle relative to the upper jaw, thereby making it less likely that the hangers will be dropped. The '058 Gregg patent has a stationary lower jaw and a movable upper jaw, the upper jaw being movably hinged at the back of a rigid c-shaped frame in the clamp rather than being fixed to the top wall of the garment bag.

A previous commonly owned application Ser. No. 163,642 filed Mar. 3, 1988 and entitled "Hanger-Retaining Clamp for Garment Bags" discloses a different form of clamp having a stationary lower support bar and a movable means bearing down on the hangers over the whole length of the bar using an eccentric pivoting element.

British patent No. 1,122,257-Carl discloses a simpler form of rigid c-shaped trolley clamp. In Carl as in Gregg and in the aforesaid application, the rigid nature of the lower support bar of the trolley clamp prevents loss of the hangers by falling forward along a tilting lower jaw when the clamp opens. Carl lacks any positive means for retaining the hangers, instead having a closure at the extreme front of the trolley clamp such that hangers are at most only loosely retained within the internal space of the c-shaped frame. It will be appreciated that this loose retention of the hangers frequently will allow a hanger to escape. One could make the vertical opening in c-frame type clamps very narrow, thereby making loss of the hangers less likely. The drawback of this approach is that the hangers are also more difficult to insert and remove.

A basic difficulty with trolley clamps having two opposed jaws is that relatively complicated clasp structures are required to force the jaws to remain against one another to thereby hold the hangers in place. Even when the jaws are closed, the hangers hold the jaws apart at a space, whereby any thin hangers are only loosely held if thick hangers are clamped nearby at the same time. In Gregg, an eccentric tab pushes upwardly against the top of the c-frame to force an intermediate jaw downward within the opening defined by the c-shaped frame, and the jaws are at least partly made of resilient rubber or the like to better accommodate varying hanger thicknesses. The eccentric is jammed in place when the clip is closed. Among the remaining patents, each requires a pivotable loop element or bail attached to one jaw for reaching around and grasping a distal end of the other jaw, to hold the clamp closed. These clasp elements require the user to manipulate the trolley clamp with two hands, and may obstruct free access to the open end of the trolley clamp for placing and removing hangers.

According to the present invention, a relatively uncomplicated eccentric tab is provided at the front of a trolley clamp, the eccentric being arranged such that it never substantially obstructs the opening between the top and bottom of the c-shaped frame, whether the clamp is open or closed. This is accomplished by abandoning the concept of closeable opposed jaws in a trolley clamp, instead providing a plurality of movable retaining elements that are forced against one another to retain the clothes hangers in place by means of a force directed in a forward/backward direction along a support bar rather than upwardly or downwardly against the bar or like fixed jaw. As a result, each hanger is retained between two independent retaining elements which are inherently spaced correctly for any size hanger.

The eccentric of the invention for urging the retaining elements together is also mounted for linear displacement relative to its turning axis, with a spring or similar resilient element providing a substantial span over which the eccentric will exert a force against the plurality of movable hanger retaining elements between which individual hangers are placed. Inasmuch as the spacing between any two retaining elements alotted to grasping a particular hanger is wholly independent of the spacing of the elements grasping other hangers, large and small hangers can be mixed on a trolley clamp without compromising the security of their attachment. Individual clamp element spacing is a substantial improvement over the prior art jaw method, wherein the same jaws grasps all the hangers, thereby requiring resilient (e.g. rubber) jaw parts and/or allowing thicker hangers to keep the jaws apart and preventing a tight grasp of thinner hangers. Nevertheless, all the hanger retaining elements are brought together or "closed" around their hangers using a single simple and easily operated lever control.

The invention has the advantages of the convenience of a rigid c-shaped frame as in the British patent to Carl, the convenience of a simple tab operator as in Gregg '058 and furthermore enjoys clamping dimensions specific to any size of hangers, uniform or mixed.

SUMMARY OF THE INVENTION

It is an object of the invention to provide a durable and convenient trolley clamp in which hangers are retained with maximum security while allowing the clamp to be manipulated conveniently with one hand.

It is another object of the invention to provide a clamping structure in a trolley clamp that will accommodate a wide variety of hanger wire diameters.

It is yet another object of the invention to provide a trolley clamp of the foregoing type which is easy and inexpensive to build and use.

These and other objects are accomplished by a trolley clamp for retaining hangers in a garment bag, which has a rigid frame with an at least partly horizontal lower support bar and structure for mounting the support bar below a top inside of the garment bag. The support bar carries a plurality of movable hanger-retaining elements between which clothes hangers are captured when the movable elements are abutted against one another. The hanger retaining elements have concavities such as half-round depressions for matching the contour of the clothes hangers. A pivotable eccentric at the front distal end of the support bar is movable to exert a force along the longitudinal axis of the support bar, forcing the hanger retaining elements into abutment and thereby capturing any clothes hangers disposed between the hanger retaining elements, or allowing the hanger retaining elements to separate from one another, thereby opening space for removal of the clothes hangers.

BRIEF DESCRIPTION OF THE DRAWINGS

There are shown in the drawings the embodiments that are presently preferred. It should be understood that the invention is not limited to the precise arrangements and instrumentalities shown in the drawings, wherein.

DETAILED DESCRIPTION OF THE PREFERRED EMBODIMENTS

Figure 1:
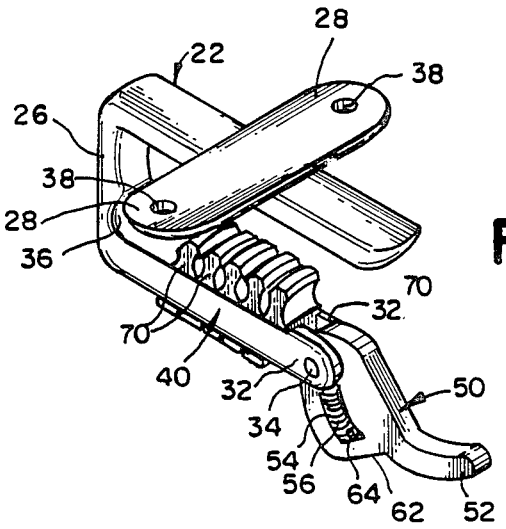
FIG. 1 shows the trolley clamp of the invention with the movable hanger retaining elements unlocked.

The trolley clamp in the invention is shown in perspective in FIG. 1. The clamp includes a rigid frame 22 which is attached to the top of a garment bag or the like (not shown) by means of wing-like supports 28, which extend transversely from the plane defined by the clamp. Wings 28 are attachable to the garment bag by suitable fasteners (e.g. rivets) disposed at least through a wall of the garment bag and through connector holes 38. Wings 28 can be attached at the top inside wall of the garment bag, thereby holding the lower support bar of the frame at a space below the top sufficient for receipt of hangers. In the preferred embodiment, frame 22 is rigid and c-shaped. It is also possible to arrange a clamp wherein the frame is a closed shape (hangers being insertable from the side) or wherein connection means such as wings 28 otherwise fix a support bar for hangers at a space below the top inside wall of a garment bag. For example, wings 28 can be mounted to the rear 26 or even to the back portion of the support bar 40 of frame 22, rather than to top 24 as shown. In each case, the result is a support bar fixed in an at least partly horizontal position below an overhead surface such as the inside top wall of the garment bag.

A space 30 is defined between the support bar 40, which may be defined by two spaced member 32, and the next structure toward the top of the garment bag. The next structure may be the top of the bag itself or top member 24 of the rigid frame 22. Clothes hangers, normally having a downwardly-opening hook at an upper end whereby the hanger can be hung on closet rods, can be hung in the same way over the lower support bar. The user moves the hooks of the hangers rearwardly through opening 30, or threads the distal end of the hook of each hanger transversely across the lower support bar 40. By allowing a maximum space and minimum obstruction between the lower support bar and the top frame member 24 (or top of the garment bag), a maximum of free access is allowed for placing and removing hangers.

According to the invention, the lower support bar 40 carries a plurality of slidable hanger-retaining elements 70 thereon. The lower support bar can be bifurcated such that the slidable elements 70 are carried between spaced bars 32. The lower bar can also be unitary, and the device arranged such that the slidable hanger-retaining elements 70 enclose part way around the outside of the lower support bar 40 rather than being carried between bifurcated support bar elements 32 as shown. Bar 40 supports the vertical weight of the hangers. Elements 70 engage the transverse sides of each hanger's hook.

Figure 2:
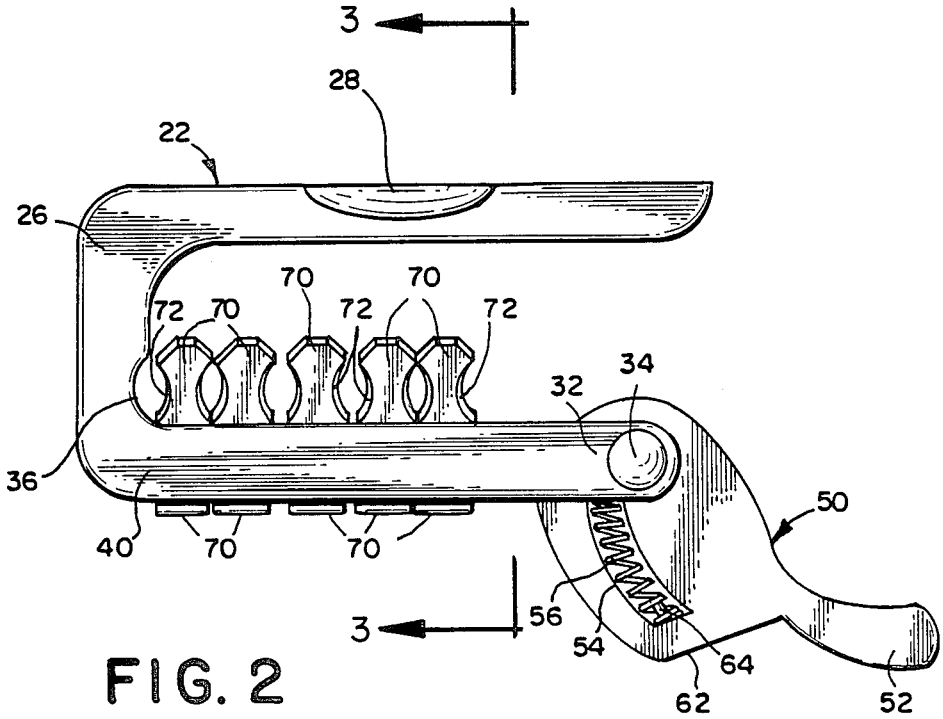
FIG. 2 is a side elevation view of the device of FIG. 1.

Each of the movable hanger retaining elements 70 has a concave face or depression complementing the typical curve and diameter of a hanger hook, which depression will partly engage a hanger when movable elements 70 are abutted against one another or at least forced toward one another on opposite sides of a hanger hook. In FIG. 2, movable elements 70 are shown with hanger-retaining depressions 72 on both sides, each of these movable elements 70 being identical. The rearmost of the elements 70 has its depression 72 opposed against a corresponding depression 36 in the back 26 of frame 22. Therefore, the rearmost of the movable elements 70 does not bear against another movable element 70, but rather bears against the fixed frame. The foremost of the movable elements 70 need not have a hanger-retaining depression on both sides because only the rear-facing depression will be operable. It is also possible to provide a hanger-retaining depression on the finger tab 50 provided for forcing movable elements 70 toward one another along the longitudinal axis of bar 40 and toward the back 26 of the frame 22.

Figure 3:
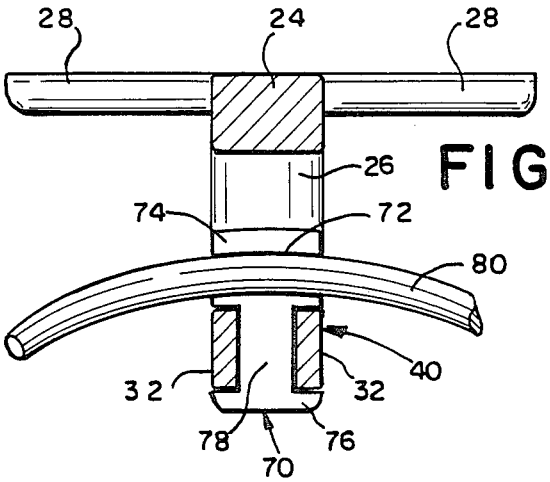
FIG. 3 is a partial section view taken along lines 3—3 in FIG. 2.

FIG. 3, which is a partial section view through lines 3—3 in FIG. 2, shows the preferred engagement between movable hanger-retaining elements 70 and the bifurcated bars 32 that comprise the lower support bar 40. Bars 32, together with top 24 and rear 26, define a rigid c-shaped frame attachable to the garment bag via wings 28. The individual movable elements 70 each have a depression 72 for grasping part way around clothes hangers 80 in the top sections 74 of elements 70. A bottom section 76 of elements 70 extends outwardly such that elements 70 are captive on bifurcated members 32 of the lower support bar 40 but are slidable along bar 40. Elements 70 are slidable because their top parts 74 engage members 32 of bar 40 from above, bottom sections 76 engage members 32 from below, and the are slidable while captive between bars 32 of mid-sections 78 the lower support bar. Hanger-receiving depression 72 defines a shallow concavity, curved for a hanger hook and matched to the depression 72 in the next adjacent hanger-retaining element 70 or against the depression 36 in the rear frame member 26, such that each set of opposed depressions fits sufficiently around each hanger to hold the hanger in place. Due to the curve and contour of depressions 70, 36, hangers engaged in the device are not only kept from falling off the clamp and dropping into the garment bag, but also are kept from swinging back and forth either in the plane of bar 40 or perpendicular thereto. This keeps the user's garments in place on the hangers as well as keeping the hangers in place on bar 40.

In order to release the hangers or to open the clamp for receipt of hangers, the hand-manipulated pivoting tab 50 as shown in FIG. 2 is rotated such that the eccentric surface 58 of tab 50 is moved away from the foremost one of movable elements 70. This allows space to be opened between any two of the individual hanger retaining elements 70, through which space the hangers can be moved upwardly or downwardly, off the lower support bar to remove them or onto the lower support bar to place them for clamping. The tops of elements 70 are tapered whereby downward force on a hanger will force adjacent elements 70 to move apart. The unclamped elements 70 separate when a hanger is rested thereon. With sufficient force the elements 70 can be forced apart even when clamped, due to the resilient mounting of tab 50. Similarly, when the device is unclamped, hangers can be simply lifted upwardly, which motion separates the adjacent elements 70 of itself. When movable elements 70 are separated, the lower members 32 of the support bar keep the hangers in place in the same manner as a closet bar, simply defining a horizontal member supporting their weight but allowing them to swing. As shown in FIG. 3, the lateral edges of movable elements 70 at each end of the hanger-receiving depression 72 are arranged to taper off to the level of support bar 40, such that the hanger will be positioned directly on the bifurcated support bar 40 if not by the abutment of movable hanger retaining elements 70 on either side of the hanger.

It is entirely possible according to the invention to load the entire trolley clamp with relatively wide plastic hangers or with relatively narrow thin wire hangers. Unlike known devices it is furthermore possible to mix these diameters without adverse consequences. Inasmuch as the individual movable elements 70 can be positioned anywhere on the lower support bar 40, a thin hanger will not be held loosely just because a nearby thick hanger is being held in the same clamp. Of course the result of allowing a variation in hanger diameter is that the means for exerting a force along the longitudinal axis of bar 40 to bring the individual hanger retaining elements into 70 into abutment must exert adequate force at any spacing over a wide-enough span to encompass the thinnest possible hangers (or an empty clamp) up to a full set of the thickest possible hangers to be employed. Accordingly, movable locking element 50 is provided with an elongated slot 54 with a resilient element 56 therein, allowing locking element 50 to be closed and locked anywhere over a wide span of adjustment.

Figure 4:
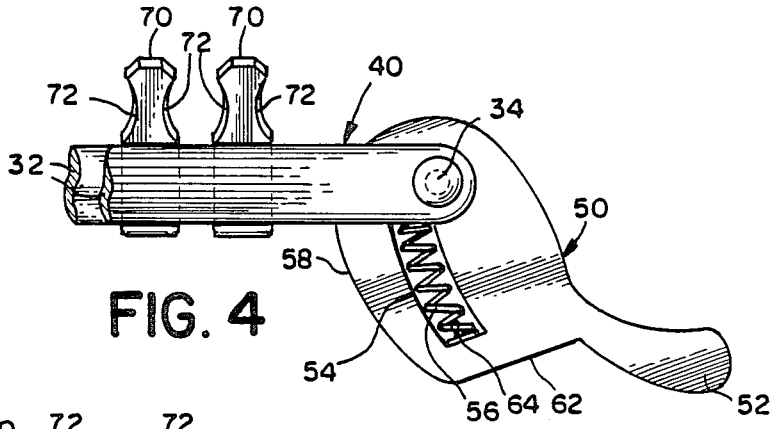
FIG. 4 is a partial elevation view showing the position of the movable eccentric finger tab with the clamp open.
Figure 5:
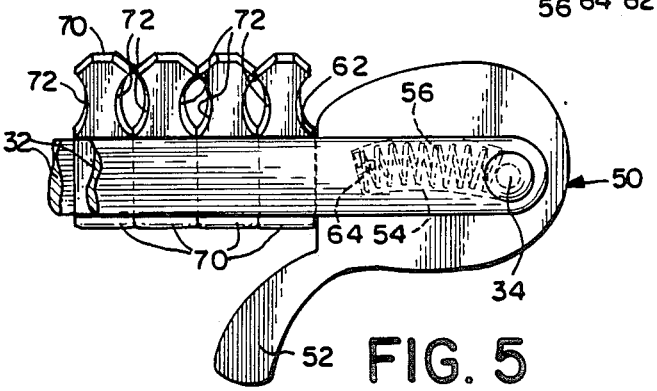
FIG. 5 is a partial elevation view corresponding to FIG. 4, with the clamp shown closed.

Locking tab 50 is carried pivotably on a horizontal axis defined by fastener 34, for example a bolt or rivet, connecting the distal ends of bifurcated bars 32 of support bar 40. Tab 50 has an eccentric surface defining an increasing tab diameter along surface 58 whereby upon rotating the tab 50 clockwise as shown in FIG. 2 or FIG. 4, surface 58 bears against the foremost one of slidable hanger retaining elements 70, forcing it into abutment with the next successive element 70, and so on. Upon completely rotating tab 50 in a clockwise direction, a flat surface 62 is brought into engagement with the face of the foremost hanger retaining element 70, which is also flat, whereupon finger tab 50 becomes locked in a stable position with a force from spring 56 being exerted on all the individual hanger retaining elements 70. The force of tab 50 pushes hanger retainers 70 either into direct abutment as shown in FIG. 5, or into abutment with an intervening hanger 80, as shown in FIG. 3. In the latter case, locking element 50 in the closed position as shown in FIG. 5 becomes displaced along its slot 54 somewhat toward the distal end of lower support bar 40, which displacement is accommodated by compressing helical spring 56 in slot 54 of tab 50. Spring 56 is pressed against rivet 34 at one end of support bar 40, and against the inner surface of slot 54 of tab 52 at the opposite end of the spring 56. Said opposite end of the spring is kept in the slot by means of a protruding pin 64, inserted into the end of helical spring 56. The other end of the spring, namely the end bearing against rivet 34 is held in place between the distal ends of members 32 defining the bifurcated lower support bar 40.

Inasmuch as the locking element 50 is disposed forward of and below the supporting surface for the hangers as defined by lower support bar 40, the vertical dimension of the opening between the lower support bar 40 and the top frame member 24 can be relative small, for example 1.5 cm. In connection with a clamp arranged, for example, with five movable retaining elements 70 and dimensioned to permit the use of wire hangers or plastic hangers or both, about 1 cm of clearance is preferably provided between the movable elements 70 and opposing surfaces 58, 36, when the clamp is open. When the clamp is closed, the variation in span is taken up by a variable amount of compression of spring 56 in slot 54, also having about 1 cm of span.

The clamp is preferably a cast metal structure with the c-shaped frame members 24, 26, 32, and the support wings 28 cast integrally. The clamp can be plated with a suitable corrosion-resistant finish. Movable elements 70 are installed between the bifurcated legs 32 of lower support bar 30. Spring 56 is then installed in tab 50 and tab 50 is attached between legs 32 by means of rivet 34. Spring 56 can also be installed after the attachment of tab 50 by means of rivet 34.

A number of variations are possible and will now be apparent to persons skilled in the art. It is possible to mount lower support bar 40 by means other than defining a complete c-shaped frame. The c-shaped frame is preferred for strength, and because a front opening is convenient for the user. Tab 50 can take many different shapes, and need not be mounted on a horizontal pivot as shown. For example, tab 50 could be mounted on a vertical pivot bearing against a foremost one of the movable elements 70. Similarly, an eccentric tab 50 could be mounted elsewhere on the frame, for example at the rear edge of lower support bar 40 rather than at the front, in that case requiring an abutment at the distal front end of legs 32 of support bar 40 for keeping the movable elements 70 captive on bar 40 of the clamp.

Other forms of resilient biasing means can replace helical spring 56, for example compressible rubber or the like. Similarly other means than flat surface 62 can be provided for ultimately locking the locking tab 50 in place, or the means whereby tab 50 is locked can be the eccentric surface 58 itself, namely by jamming tab 50 tightly enough to frictionally lock against the movable elements 70 and the intervening hangers.

The invention as disclosed herein is a clamp for retaining hangers, comprising a rigid frame member 22 having an at least partly horizontal support bar 40 and means 28 for mounting the support bar below an overhead surface, an insertion space 30 being defined between the support bar 40 and the overhead surface, the support bar defining a longitudinal axis and being dimensioned to carry hangers 80 for clothing and the like. A plurality of hanger retaining elements 70 are slidably carried on the support bar 40, each of the hanger retaining elements 70 having at least one contoured face 72 disposed towards another of the hanger retaining elements 70 along the longitudinal axis of the support bar 40, the contoured face 72 being dimensioned to partly enclose one of said hangers 80, and facing pairs of the hanger retaining elements 70 being separable to permit removal of hanger 80 from the support bar 40 and, a resilient means 50, 56 urging the hanger retaining elements 70 on the support bar 40 together, the resilient means 50, 56 being lockable to fix the hanger retaining elements 70 against one another.

The hanger retaining elements 70 have a curving groove 72 disposed transverse to the longitudinal axis of the support bar 40, for engaging the hangers 80 at a hooked upper end thereof.

The hanger retaining elements 70 can also have tapered upper ends 74 whereby vertical movement of a hanger 80 results in displacement of the hanger retaining elements 70 on the support bar 40 to admit the hanger 80 between said elements 70. The hanger retaining elements 70 are slidably carried in an elongated slot in the support bar. The support bar 40 is preferably bifurcated, the elongated slot being defined by coextensive sides 32 of the support bar 40.

A pin 34 preferably bridges distal ends of the coextensive sides 32 of the support bar 40, the resilient means 50, 56 including an eccentric element 50, 58 rotatable on the pin 34 to bear against an endmost one of the hanger retaining elements 70.

The eccentric element 50, 58 has a slot 54 for receiving the pin 34, the slot 54 being elongated in a direction substantially aligned to the longitudinal axis of the support bar 40 when the eccentric element 50, 58 is rotated to bear against said endmost one of the hanger retaining elements 70, and element 50 is provided with a resiliently compressible element 56 disposed in the slot 54, the resiliently compressible element 56 urging the eccentric element 58 toward the endmost hanger retaining element 70 by pressing against the pin 34 and against an inside 64 of said slot 54 in the eccentric element 50, 58.

The support bar 40 can be a lower leg 40 of a rigid c-shaped frame 22, the device further comprising means for mounting an upper leg 24 of said c-shaped frame 22 to an inside top gusset of a garment bag. Means for mounting the upper leg 24 includes at least one wing 28 extending transversely from a plane of the c-shaped frame 22 and a fastener means 38 disposed in the wing. The eccentric element 50 is preferably rotatable in a plane of the c-shaped frame 22, and the device further comprises a finger tab 52 extending from the eccentric element 50, 58 for manipulating the eccentric element 50, the finger 52 tab being disposed against the endmost hanger retaining element 70 when the eccentric element 50, 58 is rotated to bear against the endmost one of the hanger retaining elements 70.

The hanger retaining elements 70 are slidably captive on the support bar 40 by means 74, 76 defining enlargements of the hanger retaining elements 78 disposed above and below the support bar, connected by body portions disposed in an elongated slot in the support bar 40.

A trolley clamp for removably fixing clothes hangers 80 and the like at a top gusset of a garment bag, comprises a c-shaped frame 22 having a top 24, a rear 26 and bottom 40 disposed in a plane, the frame 22 having means 28 for attachment to the garment bag such that the bottom 40 is placed at a space from a top inside of the garment bag. A plurality of hanger retaining elements 70 are disposed on the bottom 40 of the c-shaped frame 22, said bottom defining a support bar 40 for carrying the hangers 80 when hung over the support bar 40, each hanger 80 being put between two of the hanger retaining elements 70, the hanger retaining elements 70 being movable toward and away from one another along the support bar 40 and bearing against one another and against ends 26, 58 of the support bar 40 when moved fore and aft on the support bar 40, the hanger retaining elements 70 having contoured faces 72 on sides of the hanger retaining elements 70 oriented fore and aft, whereby said hangers 80 are captive between hanger retaining elements 70 disposed on either side thereof and an endmost hanger is captive between an endmost hanger retaining element and the rear 26 of the c-shaped frame. A manually operable finger tab 50 is movably disposed on a front end of the support bar 40, the finger tab having a surface 58 movable toward and away from a foremost one of the hanger retaining elements 70 when the finger tab is manipulated to bring together the hanger retaining elements and thus capture the hangers, and also to allow the hanger retaining elements to be spaced and thus release the hangers 80. The support bar 40 is bifurcated to define a slot for the hanger retaining elements 74, 76, which are captive because they are wider than the slot above and below the support bar 40. The finger tab 50 is pivotable on a pin 34 at a front end of the support bar 40 and has an eccentric surface movable to bear against a foremost one of the hanger retaining elements 70 upon rotating the finger tab 50 around the pin 34.

The pin 34 may be perpendicular to a plane defined by the c-shaped frame 22, such that the tab 50 resides in the slot in support bar 40. The finger tab 50 has a slot 54 in which the pin 34 is placed, and the device further comprises a resilient element 56 in the slot, the resilient element 56 urging the finger tab 50 against an endmost one of the hanger-retaining elements 70 by bearing between the pin 34 and an end of the slot 54. The resilient element is preferably a helical spring 56.

The finger tab 50 has a handle 52 extending substantially radially relative to the pin 34, the handle 52 being located adjacent a maximum diameter of the eccentric surface 58 of the finger tab 50, and the handle 52 resting against one of the endmost hanger retaining elements 70 and the support bar 40, when the finger tab 50 is rotated to bear against the endmost hanger retaining element 70, whereby the trolley clamp is lockable in a closed condition.

In view of these variations and others within the scope of the invention, reference should be made to the appended claims rather than the foregoing specification as indicating the true scope of the invention.

What is claimed is:

1. A clamp for retaining hangers, comprising:

a frame member having an at least partly horizontal support bar and means for mounting the support bar below an overhead surface, an insertion space being defined between the support bar and the overhead surface, the support bar defining a longitudinal axis and being dimensioned to carry hangers for clothing and the like;

a plurality of hanger retaining elements slidably carried on the support bar, each of the hanger retaining elements having at least one contoured face disposed towards another of the hanger retaining elements along the longitudinal axis of the support bar, the contoured face being dimensioned to partly enclose one of said hangers, facing pairs of the hanger retaining elements being separable to permit removal of the hanger from the support bar; and, resilient means urging the hanger retaining elements on the support bar together, the resilient means being lockable to fix the hanger retaining elements against one another.

2. The clamp of claim 1, wherein the hanger retaining elements have a curving groove disposed transverse to the longitudinal axis of the support bar, for engaging the hangers at a hooked upper end thereof.

3. The clamp of claim 1, wherein the hanger retaining elements have tapered tops such that a hanger forced downwardly tends to separate adjacent ones of the hanger retaining elements.

4. The clamp of claim 1, wherein the hanger retaining elements are slidably carried in an elongated slot along the support bar.

5. The clamp of claim 4, wherein the support bar is bifurcated, the elongated slot being defined by coextensive sides of the support bar.

6. The clamp of claim 5, further comprising a pin bridging distal ends of the coextensive sides of the support bar, the resilient means including an eccentric element rotatable on the pin to bear against an endmost one of the hanger retaining elements.

7. The clamp of claim 6, wherein the eccentric element has a slot receiving the pin, the slot being elongated in a direction substantially aligned to the longitudinal axis of the support bar when the eccentric element is rotated to bear against said endmost one of the hanger retaining elements, and further comprising a resiliently compressible element disposed in the slot, the resiliently compressible element urging the eccentric element toward the endmost hanger retaining element by pressing against the pin and against an inside of said slot in the eccentric element.

8. The clamp of claim 1, wherein the support bar is a lower leg of a rigid c-shaped frame, and further comprising means for mounting an upper leg of said c-shaped frame to an inside top gusset of a garment bag.

9. The clamp of claim 8, wherein the means for mounting the upper leg includes at least one wing extending transversely from a plane of the c-shaped frame and a fastener disposed in the wing.

10. The clamp of claim 7, wherein the eccentric element is rotatable in a plane of the c-shaped frame, and further comprising a finger tab extending from the eccentric element for manipulating the eccentric element, the finger tab being disposed against the endmost hanger retaining element when the eccentric element is rotated to bear against the endmost one of the hanger retaining elements.

11. The clamp of claim 4, wherein the hanger retaining elements are slidably captive on the support bar by means of enlargements of the hanger retaining elements disposed above and below the support bar, connected by body portions disposed in the elongated slot.

12. A trolley clamp for removably fixing clothes hangers and the like at a top gusset of a garment bag, comprising:

a c-shaped frame having a top, a rear and a bottom disposed in a plane, the frame having means for attachment to the garment bag such that the bottom is placed at a space from a top inside of the garment bag;

a plurality of hanger retaining elements disposed on the bottom of the c-shaped frame, said bottom defining a support bar for carrying the hangers when hung over the support bar, each hanger being put between two of the hanger retaining elements, the hanger retaining elements being movable toward and away from one another along the support bar and bearing against one another and against ends of the support bar when moved fore and aft along the support bar, the hanger retaining elements having contoured faces on sides of the hanger retaining elements oriented fore and aft, whereby said hangers are captive between hanger retaining elements disposed on either side thereof and an endmost hanger is captive between an endmost hanger retaining element and the rear of the c-shaped frame;

a manually operable finger tab movably disposed on a front end of the support bar, the finger tab having a surface movable toward and away from a foremost one of the hanger retaining elements when the finger tab is manipulated to bring together the hanger retaining elements and thus capture the hangers, and also to allow the hanger retaining elements to be spaced and thus release the hangers.

13. The trolley clamp of claim 12, wherein the support bar has a slot in which the hanger retaining elements are disposed to slide fore and aft on the support bar.

14. The trolley clamp of claim 12, wherein the support bar is bifurcated to define the slot and the hanger retaining elements are wider than the slot above and below the support bar.

15. The trolley clamp of claim 12, wherein the finger tab is pivotable on a pin at a front end of the support bar and has an eccentric surface movable to bear against a foremost one of the hanger retaining elements upon rotating the finger tab around the pin.

16. The trolley clamp of claim 15, wherein the pin is perpendicular to a plane defined by the c-shaped frame.

17. The trolley clamp of claim 16, wherein the finger tab has a slot in which the pin is placed, and further comprising a resilient element in the slot, the resilient element urging the finger tab against an endmost one of the hanger-retaining elements by bearing between the pin and an end of the slot.

18. The trolley clamp of claim 17, wherein the resilient element is a helical spring.

19. The trolley clamp of claim 17, wherein the finger tab has a handle extending substantially radially relative to the pin, the handle being located adjacent a maximum diameter of the eccentric surface of the finger tab, and the handle resting against one of the endmost hanger retaining element and the support bar, when the finger tab is rotated to bear against the endmost hanger retaining element, whereby the trolley clamp is lockable in a stable closed condition.

* * * * *